US006871621B2

(12) United States Patent
Palesch et al.

(10) Patent No.: US 6,871,621 B2
(45) Date of Patent: Mar. 29, 2005

(54) CAMSHAFT ADJUSTER FOR INTERNAL COMBUSTION ENGINES OF MOTOR VEHICLES

(75) Inventors: Edwin Palesch, Lenningen (DE); Andreas Knecht, Kusterdingen (DE); Gerold Sluka, Nürtingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 0 days.

(21) Appl. No.: 10/436,122

(22) Filed: May 12, 2003

(65) Prior Publication Data

US 2004/0226526 A1 Nov. 18, 2004

(51) Int. Cl.[7] ..... F01L 1/34

(52) U.S. Cl. ..... 123/90.17; 123/90.15; 123/90.31; 123/90.27; 464/160

(58) Field of Search ..... 123/90.15, 90.16, 123/90.17, 90.18, 90.27, 90.31; 464/1, 2, 160

(56) References Cited

U.S. PATENT DOCUMENTS 4,615,800 A * 10/1986 Stifelman et al. ..... 210/132
5,119,691 A * 6/1992 Lichti et al. ..... 74/568 R
5,720,360 A * 2/1998 Clark et al. ..... 180/305
6,250,265 B1 * 6/2001 Simpson ..... 123/90.17
6,286,309 B1 * 9/2001 Horton et al. ..... 60/468
6,363,896 B1 * 4/2002 Speier ..... 123/90.17
6,571,757 B1 * 6/2003 Simpson ..... 123/90.11
2003/0033999 A1 * 2/2003 Gardner et al.

* cited by examiner

*Primary Examiner*—Thomas Denion
*Assistant Examiner*—Ching Chang
(74) *Attorney, Agent, or Firm*—Gudrun E. Huckett

(57) ABSTRACT

A camshaft adjuster for motor vehicles has a stator and a rotor rotatable relative thereto between which pressure chambers are provided. Pressure medium is supplied in a controlled way via a valve to the pressure chambers in order to rotate the rotor relative to the stator. Mounting of the valve in the internal combustion engine of the motor vehicle is often difficult when mounting conditions are tight, sometimes even impossible. In order for the camshaft adjuster to be usable even in tight spatial conditions, the valve is arranged on the side facing away from the camshaft connection. The valve can therefore be arranged stationarily axially outside of the engine of the motor vehicle. The camshaft adjuster requires thus only little mounting space.

33 Claims, 6 Drawing Sheets

CAMSHAFT ADJUSTER FOR INTERNAL COMBUSTION ENGINES OF MOTOR VEHICLES

BACKGROUND OF THE INVENTION

The invention relates to a camshaft adjuster for internal combustion engines of motor vehicles comprising a stator and a rotor rotatable relative to the stator, between which pressure chambers are provided that are connected by lines with at least one valve via which pressure medium is supplied to the pressure chambers, respectively.

By means of camshaft adjusters, the timing of opening of intake and exhaust valves of internal combustion engines is controlled as a function of the output required at the moment. Often it is difficult to mount the valve in the internal combustion engine of the motor vehicle because there is not enough space.

SUMMARY OF THE INVENTION

It is an object of the invention to configure the camshaft adjuster of the aforementioned kind such that it can be used even in tight space conditions in the motor vehicle.

This object is solved according to the invention for the camshaft adjuster of the aforementioned kind in that the valve is arranged on the side of the camshaft adjuster facing away from the camshaft connection.

In the camshaft adjuster of the present invention the valve is arranged on the side facing away from the camshaft connection. For this reason, the valve can be arranged stationarily axially outside of the motor. The camshaft adjuster according to the invention requires thus only little mounting space. Moreover, the camshaft adjuster according to the invention can also be retrofitted.

According to another embodiment, the valve is arranged at least partially within the camshaft adjuster. In this way, no additional mounting space for the valve in the internal combustion engine is required.

Further features of the invention can be taken from the further claims, the description, and the drawings.

BRIEF DESCRIPTION OF THE DRAWINGS

The invention will be explained in more detail by means of one embodiment illustrated in the drawings. It is shown in.

DESCRIPTION OF PREFERRED EMBODIMENTS

Figure 1:
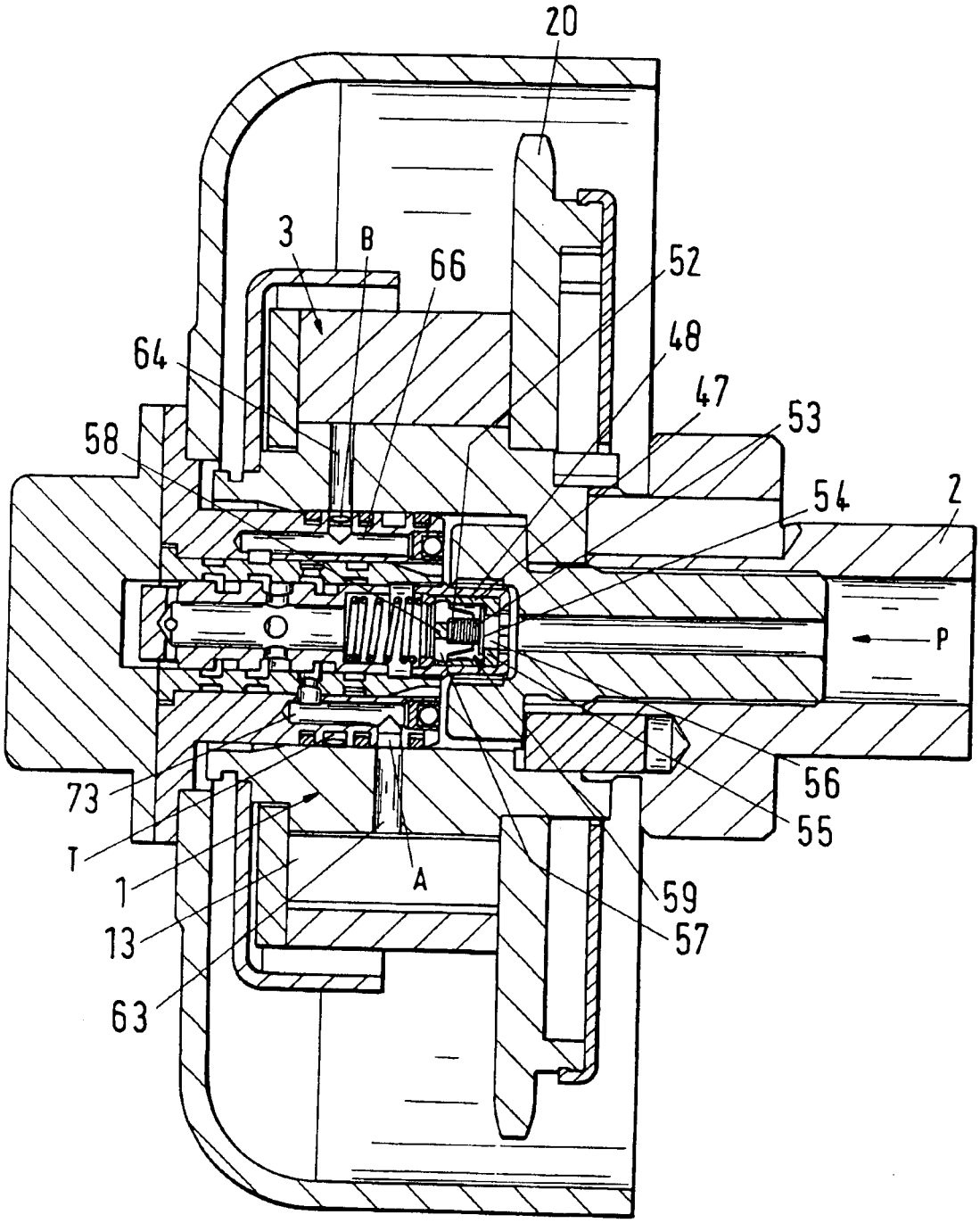
FIG. 1 in axial section a camshaft adjuster according to the invention (A and B bores)

The camshaft adjuster according to FIGS. 1 through 4 serves for adjusting the timing of opening of the intake and exhaust valves of an internal combustion engine of a motor vehicle in accordance with the output requirement of the engine. Such camshaft adjusters are known and will therefore be explained only briefly.

The camshaft adjuster has a rotor 1 which is connected fixedly to the camshaft 2. The rotor 1 is surrounded by a stator 3. It has a cylindrical jacket 4 provided on its inner wall with radially inwardly projecting stays 5 that are uniformly spaced from one another. They are identical and rest with their end faces 6 areally against an outer cylindrical peripheral surface 7 of a base member 8 of the rotor 1. Radially outwardly projecting stays 9 that are uniformly spaced project from the rotor and rest with their end faces areally and sealingly against an inner cylindrical peripheral surface 11 of the jacket 4 of the stator 3. The stays 5, 9 of the stator 3 and of the rotor 1 are configured as unitary parts of the jacket 4 and the base member 8, respectively.

Neighboring stays 5 of the stator delimit pressure chambers 12 which are divided by the rotor stays 9 into two pressure chambers 13 and 14, respectively; they are sealed relative to one another by the rotor stays 9. In the end position illustrated in FIGS. 3 and 4, the radially extending lateral surfaces 15 of the rotor stays 9 rests areally against the radially extending sidewall 16 of the stator stays 5. From this first end position, the rotor 1 can be rotated in a counterclockwise direction relative to the stator 3 by introduction of a pressure medium into the pressure chambers 14 to such an extent that the rotors stays 9 with their oppositely positioned sidewalls 17 rest against the neighboring sidewalls 18 of the stator stays 5. Between these two end positions, the rotor 1 can be rotated by a corresponding pressure loading of the sidewalls 15, 17 of the rotor stays 9 into any intermediate position relative to the stator 3.

In the inner peripheral surface 11 of the statorjacket 4 in a transitional area into the lateral surfaces 16, 18 of the stator stays 5, dirt collecting grooves 19 are provided where, during operation of the camshaft adjuster, dirt that is contained in the pressure medium is displaced as a result of centrifugal forces radially outwardly and will collect in the dirt collecting grooves 19. In this way, it is ensured that the rotor stays 9 in the respective end position rest properly against the sidewalls 16, 18 of the stator stays 5 and that no dirt particles are positioned between them. In this way, at any time a precise relative position between stator 3 and rotor 1 in the end position is ensured. The dirt collecting grooves 19 extend across the axial width of the stator 3. In deviation from the illustrated embodiment, the dirt collecting grooves 19 can be arranged, for example, also along the inner peripheral surface 11 of the stator jacket 4. It is also possible to provide the dirt collecting grooves 19 in the sidewalls 16, 18 of the stator stays 5 and/or in the sidewalls 15, 17 of the rotor stays 9. The bottom of the dirt collecting grooves 19 is curved in radial section according to FIGS. 3 and 4 so as to have a part-circular shape.

The stator 3 is closed at one side by a drive wheel 20 which can be a chain wheel or a pulley. It is screwed onto the stator 3. On the opposite side, the stator 3 is closed by a cover plate 21. It has the same outer diameter as the stator 3 and rests with its radial inner end on an annular shoulder surface 22 of the rotor 1. Advantageously, the drive wheel 20 and the cover plate 21 are connected by screwing relative to one another by screws 23 (FIGS. 3 and 4) penetrating the stator stays 5. By means of these screws 23 the drive wheel 20 and the cover plate 21 are forced axially tightly against the end faces of the stator 3. Also, the drive wheel 20 rests against an annular shoulder surface 24 on the rotor 1. The drive wheel 20 has a greater outer diameter than the stator 3.

The camshaft adjuster is covered by a hood-shaped covering cap 25 that has a radial bottom 26 penetrated centrally by a valve housing 27. It has a radially outwardly oriented flange 28 with which the valve housing 27 rests against the underside of the bottom 26 of the covering cap 25 and is fastened thereon, for example, by screws. The cylindrical jacket 29 of the covering cap 25 projects axially past the drive wheel 20 and surrounds it at a radial spacing.

The rotor 1 is provided at its end facing away from the bottom 26 of the covering cap 25 with a central recess 30 into which the camshaft 2 projects with its axial projection 31. The recess 30 of the rotor 1 is separated by a radially inwardly oriented flange 33 from a receptacle 32 for receiving the valve housing 27; the flange 33 axially delimits the recess 30. A central screw 35 projects through a central opening 34 in the flange 33 and is screwed into an axially and centrally arranged threaded bore 36 of the camshaft 2 in order to connect the camshaft adjuster to the camshaft 2. The head 37 of the screw 35 is supported on the flange 33 of the base member 8 of the rotor 1 in the axial direction. By means of the central screw 35, the rotor 1 is connected fixedly to the camshaft 2.

Figure 2:
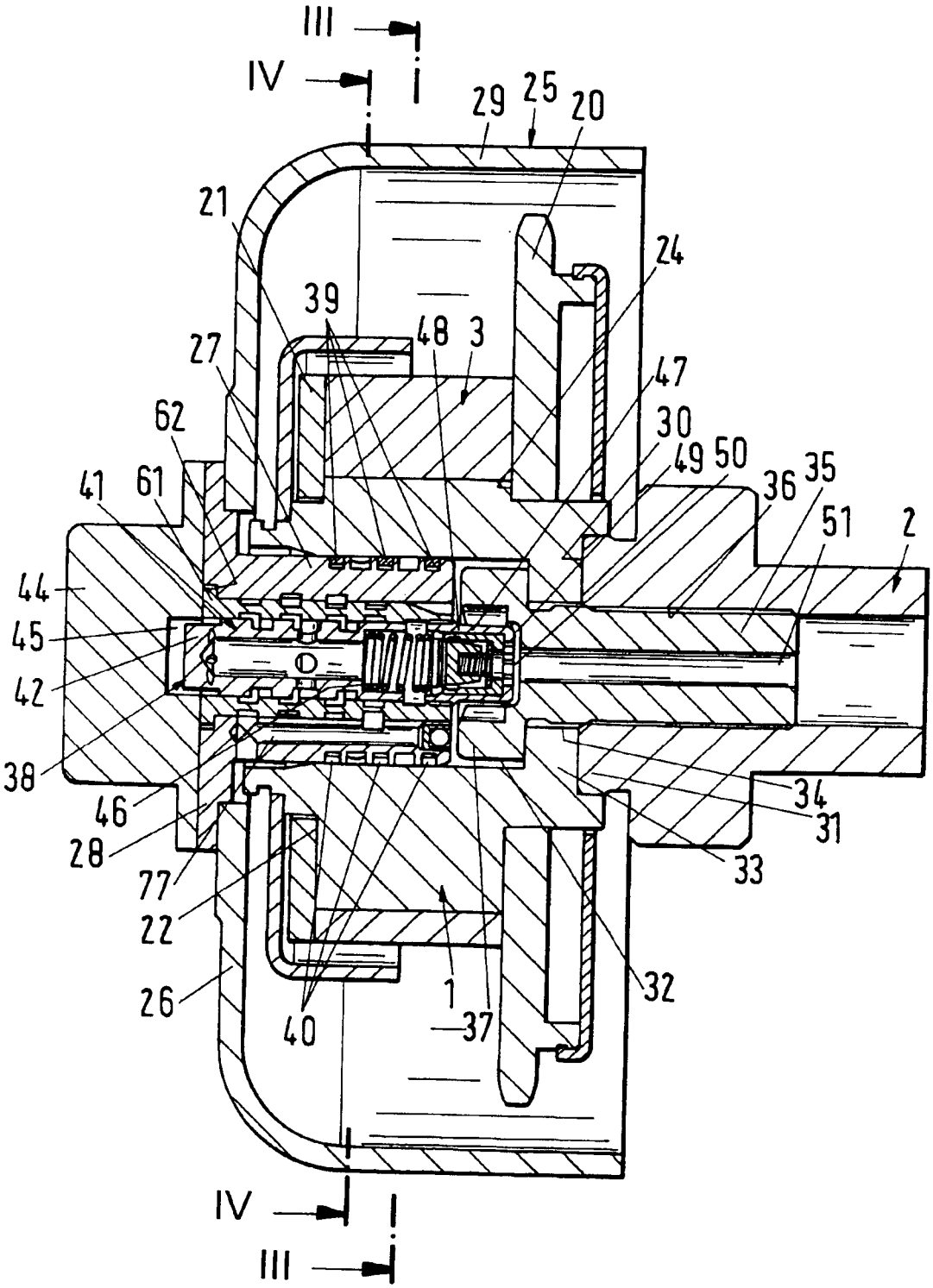
FIG. 2 in another axial section the camshaft adjuster according to the invention according to FIG. 1 (T bore)

The valve housing 27 is a component of a hydraulic valve 38 via which the hydraulic medium is supplied to the pressure chambers 13 and 14 of the camshaft adjuster in a way to be described in the following. The valve housing 27 is provided on its exterior with annular grooves 39 for receiving annular seals 40 by means of which the valve housing 27 is mounted in a seal-tight way in the receptacle 32 of the rotor 1. As illustrated in FIGS. 1 and 2, the valve housing 27 extends into close proximity of the screw head 37.

A hollow piston 41 is mounted axially slidably within the valve housing 27 and is closed at the end facing away from the screw 35 by a bottom 42. At the other end, the hollow piston 41 is open. At this end, the hollow piston 41 has a widened inner diameter. At least one pressure spring 43 projects into this end and loads the hollow piston 41 in the direction of a lid 44 that rests against the flange 28 of the valve housing 27 and is fastened thereto. The lid 44 has a central recess 45 into which the hollow piston 41 projects with its bottom 42. The pressure spring 43 is supported with one end on the radial inner shoulder surface 46 within the hollow piston 41. The other end of the pressure spring 43 rests against the end face of a bushing 47 which is received in a cup-shaped housing 48 that is screwed into the end of the valve housing 27 facing away from the lid 44. The bushing 47 is supported on the bottom 49 of the housing 48. It has at least one opening 50 via which the hydraulic medium can be supplied. The hydraulic medium is supplied centrally to the camshaft adjuster via the camshaft 2 and an axial through bore 51 in the screw 35.

The bushing 47 receives a support body 57 having at the end face facing the bottom 49 of the housing 48 a central recess 52 for receiving a pressure spring 53. By means of the pressure spring, the valve disk 54 of a check valve 59 is forced against a radial shoulder surface 55 of the bushing 47. The valve disk 54 is arranged within the bushing 47 and closes a central opening 56 of the bushing 47.

The support member 57 has a smaller outer diameter than the bushing 47. The bushing 47 is provided with a filter 58 at the side facing away from the pressure spring 53 through which the hydraulic medium will flow before entering the hollow piston 41. Contaminants in the hydraulic medium are retained in the filter 58.

The hydraulic valve 38 has two working connectors A and B, a tank connector T as well as a pressure connector P. Via the working connectors A and B, the hydraulic medium is supplied, depending on the position of the hollow piston 41, to the pressure chamber 13 or 14 of the camshaft adjuster. Via the tank connector T the hydraulic medium is returned from the pressureless pressure chambers 13 or 14 into the tank.

A check valve 59 is arranged upstream of the hydraulic valve 38 and ensures that the hydraulic medium cannot flow from the hollow piston 41 back into the camshaft 2. The force exerted by the pressure spring 53 of the check valve 59 onto the valve disk 54 is smaller than the force of the pressure spring 43 for loading the hollow piston 41.

Since the hydraulic valve 38 is provided centrally on the camshaft adjuster and is aligned with the camshaft 2, the camshaft adjuster requires only little mounting space. Therefore, the camshaft adjuster can be retrofitted in a motor vehicle. The valve housing 27 of the hydraulic valve 38 can be simply inserted from an end face of the camshaft adjuster into the receptacle 32 of the base member 8 of the rotor 1. The mounting position of the hydraulic valve 38 can be determined simply in that the flange 28 of the valve housing 27 will come to rest against the bottom 26 of the covering cap 25. The hollow piston 41 in the illustrated embodiment is slidably guided in the valve bushing 60 which is arranged in a seal-tight way in the valve housing 27. The valve bushing 60 has at its end facing the lid 44 a radially outwardly oriented flange 61 with which it rests against the bottom of a recess 62 provided at an end face of the valve housing 27. In this way, the axial mounting position of the valve bushing 60 can be simply determined. By means of the lid 44, the valve bushing 60 is secured in its position in that the lid 44 rests against the flange 61 of the valve bushing 60.

Figure 3:
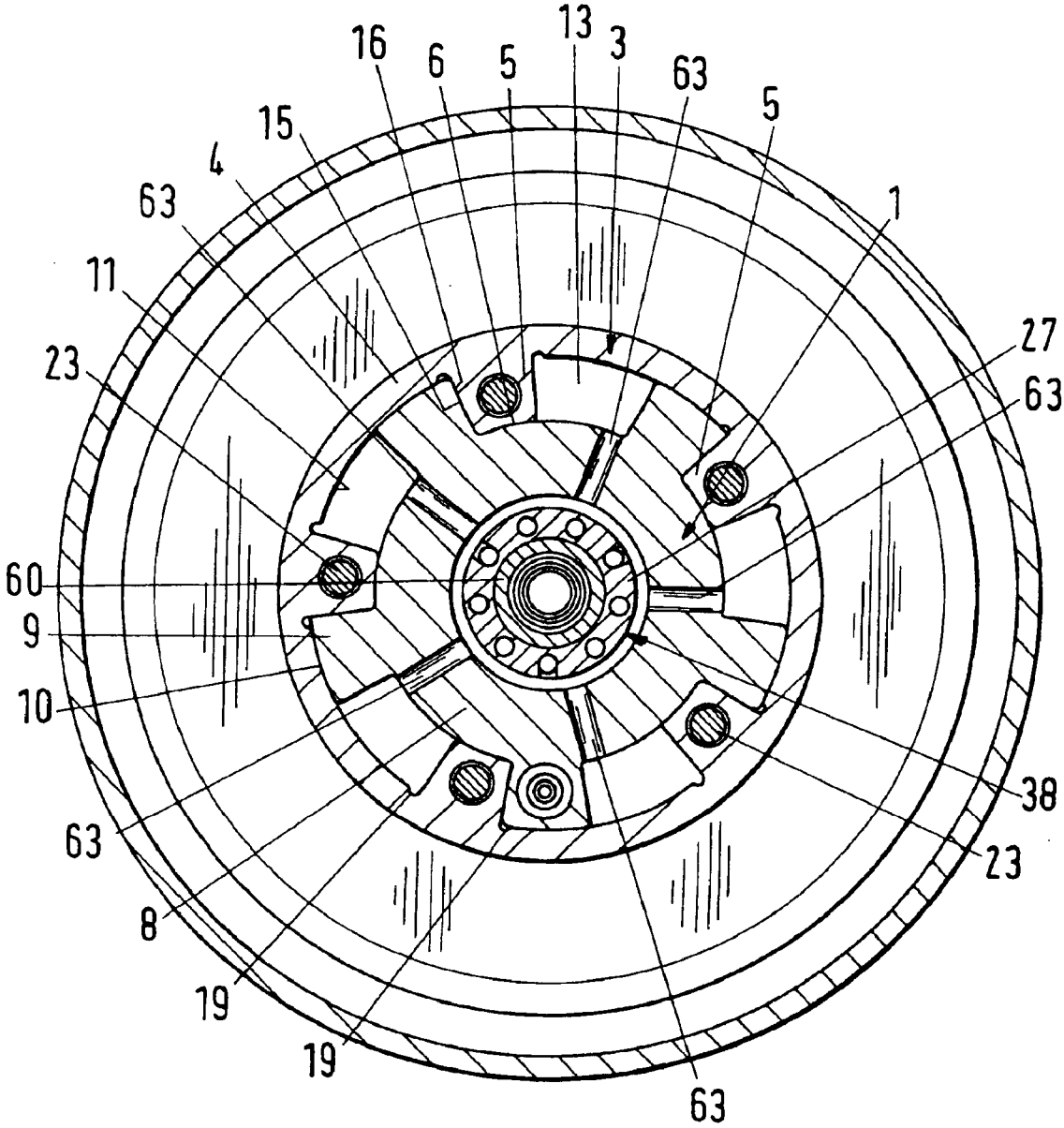
FIG. 3 a section along the line III—III in FIG. 2.
Figure 4:
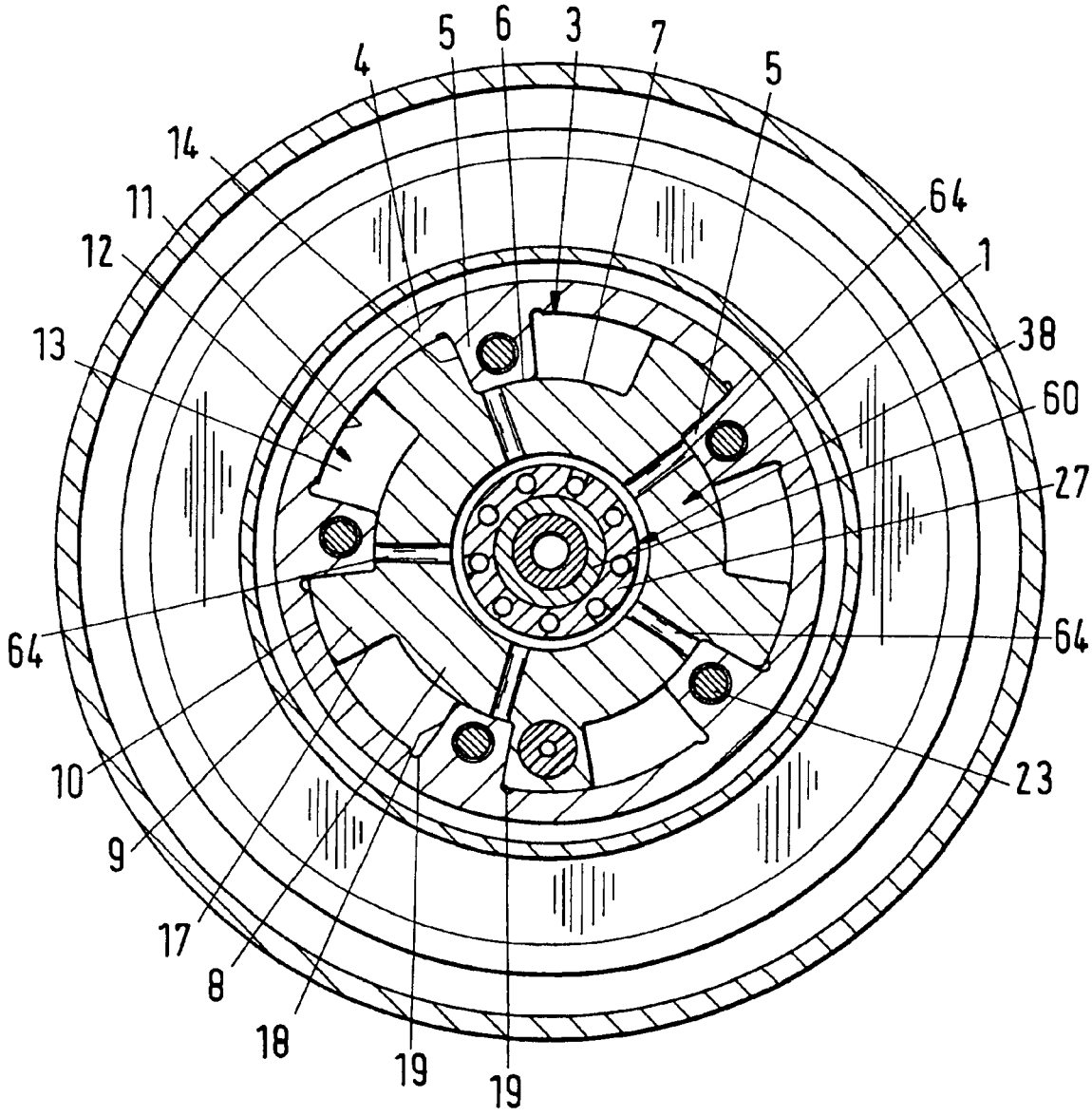
FIG. 4 a section along the line IV—IV of FIG. 2.

FIGS. 3 and 4 show that bores 63, 64, extending from the hydraulic valve 38 and penetrating radially the base member 8 of the rotor 1, open into the pressure chambers 13, 14 of the camshaft adjuster, respectively. In FIGS. 3 and 4, the pressure chambers 13 are pressurized by means of the hydraulic medium. Accordingly, the hydraulic medium is supplied via the camshaft 2, the through bore 51 of the screw 35, the check valve 59, the work connector A and the bores 63 to the pressure chambers 13. The pressure chambers 14, separated by the rotor stays 5 from the pressure chambers 13, are relieved of pressure. The hydraulic medium contained therein is displaced via the bores 64, the work connector B of the hydraulic valve 38, and the tank connector T to the tank. The hollow piston 41 of the hydraulic valve 38 is adjusted such that the hydraulic medium under pressure is supplied via the working connector A to the pressure chambers 13 and the hydraulic medium is returned from the pressure chambers 14 via the working connector B and the tank connector T to the tank. When it is desired to rotate the rotor 1 from the position according to FIGS. 3 and 4 in a counterclockwise direction relative to the stator 3, the hydraulic valve 38 is switched such that the pressure connector P is connected to the working connector B and the working connector A is connected to the tank connector T. The hydraulic medium under pressure is therefore supplied via the camshaft 2, the screw 35, the check valve 59, the working connector B, and the bores 64 to the pressure chambers 14. The hydraulic medium contained in the pressure chambers 13 is accordingly displaced via the bores 63 and the working connector A to the tank connector T.

The filter 58 upstream of the hydraulic valve 38 contributes to the robustness of the camshaft adjuster and of the entire system. The check valve 59 arranged upstream of the hydraulic valve 38 optimizes the entire performance of the system.

Figure 5:
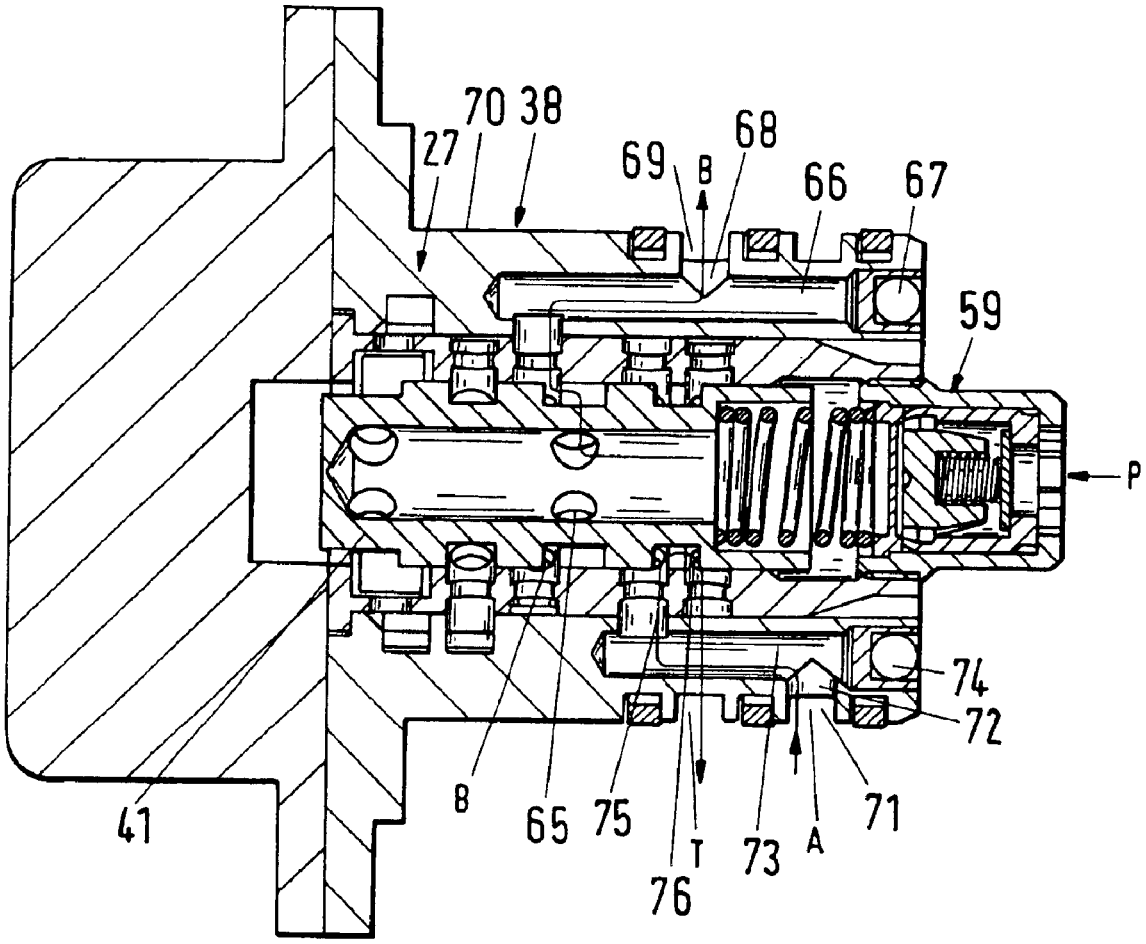
FIG. 5 on an enlarged scale and in axial section a valve of the camshaft adjuster according to the invention (A and B bores)

FIG. 5 shows in an enlarged illustration the hydraulic valve of the camshaft adjuster. FIG. 5 illustrates the situation that the hydraulic medium supplied via the axial pressure connector P from the camshaft 2 flows via the check valve 59 into the hollow piston 41. It is in such a position that the working connector A of the hydraulic valve 38 is connected to the tank connector T while the working connector B is connected to the axial pressure connector P. The hydraulic medium under pressure flows via radial openings 65 out of the hollow piston 41 into the working connector B. From here the hydraulic medium flows into axially extending bores 66 arranged within the valve housing 27 and configured as blind bores closed at their end facing the camshaft 2 by a closure part 67. Bores 68 open into the bores 66 that are provided at the bottom of an annular groove 69 in the outer peripheral surface 70 of the valve housing 27. The bores 63 open into the annular groove 69 provided within the base member 8 of the rotor.

Figure 6:
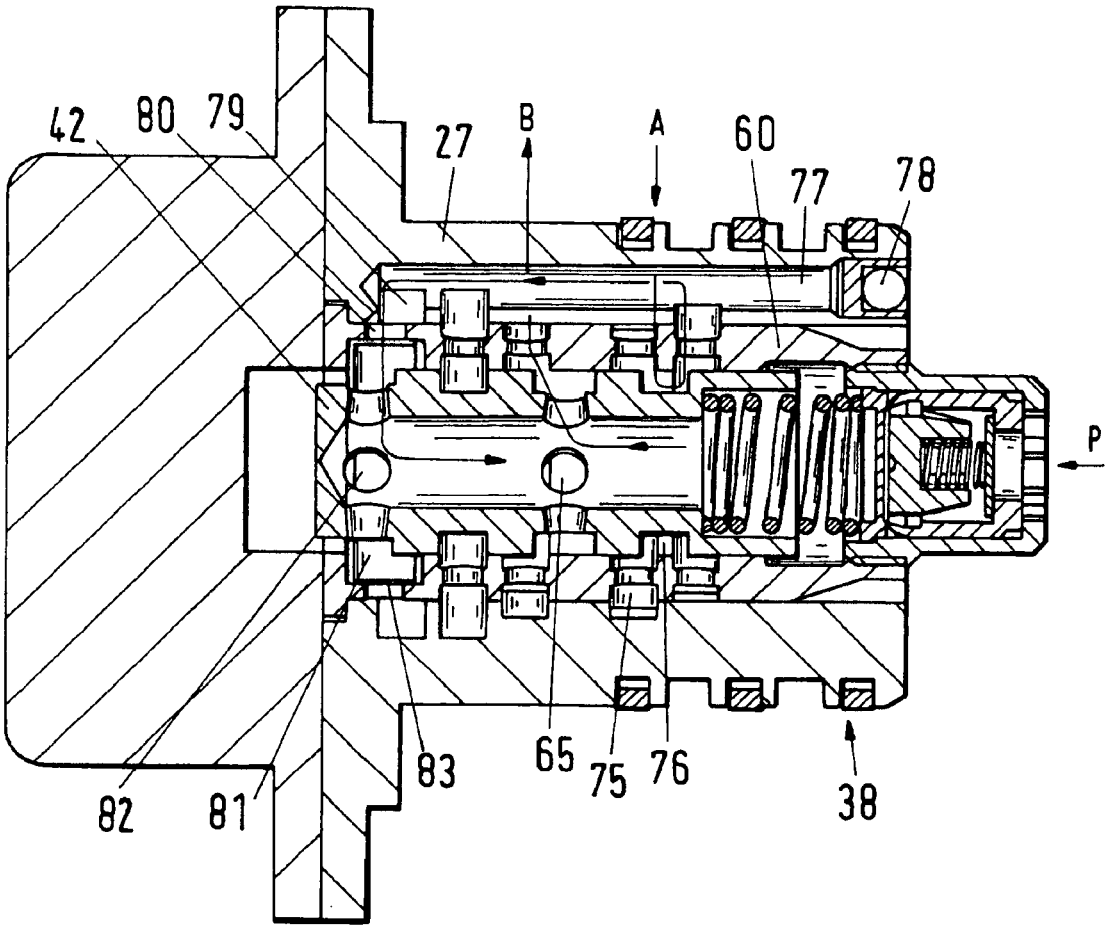
FIG. 6 in a representation corresponding to FIG. 5 another axial section of the valve of the camshaft adjuster according to the invention (T bore).

In the peripheral surface 70 of the valve housing 27 an additional annular groove 71 is provided, and bores 72 open into the bottom of this groove and are distributed circumferentially; they connect the annular groove 71 with axial bores 73 in the valve housing 27. As illustrated in FIG. 5, the bores 73 are shorter than the bores 66. The bores 73 open into the end face of the valve housing 27 facing the camshaft 2 and are closed by a closure part 74. Radial bores 64 in the base member 8 of the rotor open into the annular groove 71, positioned at an axial spacing from the annular groove 69. Radial bores 75 that are distributed about the circumference open into the axial blind bores 73 and are provided near the inner end of the blind bores 73 for connecting them to bores 76 radially penetrating the hollow piston 41. Via these bores, the hydraulic medium can be supplied to the tank connector T. FIG. 6 shows that in the valve housing 27 of the hydraulic valve 38 at least one axially extending tank bore 77 is provided and opens also at the end face of the valve housing 27 facing the camshaft 2 where it is closed by a closure part 78. On the end facing away from the closure part 78, the tank bore 77 is connected to an annular groove 79 provided in the valve housing 27; radial bores 80 that are distributed uniformly about the circumference open into the annular groove and penetrate the valve bushing 60. By means of these radial bores 80, the annular groove 79 is connected with an additional annular groove 81 provided at the inner side of the valve bushing 60 and opens into the radial bores 82 penetrating the hollow piston 41 in direct vicinity of its bottom 42.

An elastically deformable annular band 83 rests against the bottom of the annular groove 81 with elastic pretension and is axially secured. It closes the radial bores 80 of the valve bushing 60 relative to the hollow piston 41. The annular band 83 forms thus a check valve which prevents that the hydraulic medium under pressure can reach the tank bore 77 via the inner chamber of the hollow piston 41 and its radial bores 82.

In the position of the hollow piston 41 illustrated in FIG. 6, the hydraulic medium supplied axially from the camshaft 2 to the hydraulic valve 38 flows via the pressure connector P into the hollow piston 41. From here, the hydraulic medium flows via the radial bores 65 (FIG. 5) penetrating it and the axial bores 66 to the working connector B. From here, the pressure medium flows into the corresponding pressure chambers of the camshaft adjuster. The hydraulic medium displaced from the other pressure chamber, respectively, flows according to FIG. 6 via the working connector A and the bores 75, 76 into the tank bore 77. From here, the hydraulic medium flows via the annular groove 79 and the radial bores 80 to the annular band 83. It is bent elastically inwardly under the pressure of the medium so that the radial bores 80 in the valve bushing 60 are released. The hydraulic medium can therefore flow via the annular groove 81 and the radial bores 82 into the hollow piston 41. This displaced medium mixes with the pressurized hydraulic medium that is supplied via the pressure connector P and is supplied via the working connector B to the pressure chambers of the camshaft adjuster, respectively. The ring band 83 serving as a check valve prevents that the pressurized hydraulic medium can reach the tank bore 77.

In deviation from the illustrated embodiment, it is also possible to supply the hydraulic medium outside of the camshaft 2 radially to the hydraulic valve 38.

What is claimed is:

1. A camshaft adjuster for a camshaft of an internal combustion engine of a motor vehicle, the camshaft adjuster comprising:

a stator;

a rotor rotatable relative to the stator;

wherein between the stator and the rotor pressure chambers are defined;

at least one valve;

lines connecting the at least one valve to the pressure chambers;

wherein the at least one valve is configured to supply a pressure medium to the pressure chambers, respectively;

wherein the at least one valve is arranged on a side of the camshaft adjuster facing away from a connection of the camshaft adjuster to the camshaft;

wherein the rotor lips a central receptacle for the at least one valve;

wherein the at least one valve has a projecting part that protects away from the central receptacle of the rotor.

2. The camshaft adjuster according to claim 1, wherein the at least one valve is arranged at least partially within the camshaft adjuster.

3. The camshaft adjuster according to claim 1, wherein the at least one valve comprises a valve housing and wherein the rotor is mounted rotatably on the valve housing.

4. The camshaft adjuster according to claim 1, wherein the at least one valve is stationarily secured by the projecting part.

5. The camshaft adjuster according to claim 1, wherein the at least one valve is positioned coaxially to the connection of the camshaft adjuster to the camshaft.

6. The camshaft adjuster according to claim 1, wherein the at least one valve has a valve housing provided with a radially outwardly oriented flange.

7. The camshaft adjuster according to claim 6, further comprising a lid covering the at least one valve.

8. The camshaft adjuster according to claim 1, further comprising a filter arranged upstream of the at least one valve.

9. The camshaft adjuster according to claim 8, further comprising a check valve, sealing relative to a pressure connector of the at least one valve, is arranged upstream of the at least one valve.

10. The camshaft adjuster according to claim 1, wherein the pressure medium is supplied via the camshaft.

11. The camshaft adjuster according to claim 1, wherein the pressure medium is supplied radially to the at least one valve outside of the camshaft.

12. The camshaft adjuster according to claim 1, wherein the at least one valve has a valve housing provided with has at least one axial bore connectable to a working connector of the at least one valve.

13. The camshaft adjuster according to claim 1, wherein the at least one valve has a valve housing provided with at least one axial tank bore connectable to a tank connector of the at least one valve.

14. The camshaft adjuster according to claim 13, wherein the at least one valve has a hollow piston and wherein the axial tank bore communicates with an interior of the hollow piston.

15. A camshaft adjuster for a camshaft of an internal combustion engine of a motor vehicle, the camshaft adjuster comprising:

a stator;

a rotor rotatable relative to the stator;

wherein between the stator and the rotor pressure chambers are defined;

at least one valve;

lines connecting the at least one valve to the pressure chambers;

wherein the at least one valve is configured to supply a pressure medium to the pressure chambers, respectively;

wherein the at least one valve is arranged on a side of the camshaft adjuster facing away from a connection of the camshaft adjuster to the camshaft, wherein the at least one valve has a valve housing provided with a radially outwardly oriented flange;

a lid covering the at least one valve, wherein the lid is fastened to the flange of the valve housing.

16. The camshaft adjuster according to claim 15, further comprising a covering cap engaging at least partially across the camshaft adjuster, wherein the flange of the valve housing is fastened on the covering cap.

17. A camshaft adjuster for a camshaft of an internal combustion engine of a motor vehicle, the camshaft adjuster comprising:

a stator;

a rotor rotatable relative to the stator;

wherein between the stator and the rotor pressure chambers are defined;

at least one valve;

lines connecting the at least one valve to the pressure chambers;

wherein the at least one valve is configured to supply a pressure medium to the pressure chambers, respectively;

wherein the at least one valve is arranged on a side of the camshaft adjuster facing away from a connection of the camshaft adjuster to the camshaft, wherein the at least one valve acts as a bearing of the camshaft adjuster.

18. The camshaft adjuster according to claim 17, wherein the rotor has a central receptacle for the at least one valve.

19. The camshaft adjuster according to claim 18, wherein the at least one valve has a projecting part that project away from the central receptacle of the rotor.

20. A camshaft adjuster for a camshaft of an internal combustion engine of a motor vehicle, the camshaft adjuster comprising:

a stator;

a rotor rotatable relative to the stator;

wherein between the stator and the rotor pressure chambers are defined;

at least one valve;

lines connecting the at least one valve to the pressure chambers;

wherein the at least one valve is configured to supply a pressure medium to the pressure chambers, respectively;

wherein the at least one valve is arranged on a side of the camshaft adjuster facing away from a connection of the camshaft adjuster to the camshaft, a filter arranged upstream of the at least one valve;

a check valve, sealing relative to a pressure connector of the at least one valve, arranged upstream of the at least one valve, wherein the check valve is arranged upstream of the filter.

21. The camshaft adjuster according to claim 20, wherein the filter and the check valve are combined to a modular unit.

22. The camshaft adjuster according to claim 21, wherein the at least one valve has a valve housing and wherein the modular unit is inserted into the valve housing.

23. The camshaft adjuster according to claim 21, wherein the modular unit has a housing screwed into the valve housing.

24. The camshaft adjuster according to claim 21, comprising a screw fastening the rotor to a camshaft, wherein the modular unit projects into the screw.

25. The camshaft adjuster according to claim 24, wherein the screw has an axial bore for supplying the pressure medium.

26. The camshaft adjuster according to claim 24, wherein the screw is screwed into the camshaft.

27. A camshaft adjuster for a camshaft of an internal combustion engine of a motor vehicle, the camshaft adjuster comprising:

a stator;

a rotor rotatable relative to the stator;

wherein between the stator and the rotor pressure chambers are defined;

at least one valve;

lines connecting the at least one valve to the pressure chambers;

wherein the at least one valve is configured to supply a pressure medium to the pressure chambers, respectively;

wherein the at least one valve is arranged on a side of the camshaft adjuster facing away from a connection of the camshaft adjuster to the camshaft, wherein the at least one valve has a valve bushing inserted into a valve housing of the at least one valve.

28. The camshaft adjuster according to claim 27, wherein the valve housing has an end face with a recess and the valve bushing has a radially outwardly oriented flange, wherein the radially outwardly oriented flange is positioned within the recess valve housing.

29. The camshaft adjuster according to claim 28, further comprising a lid covering the at least one valve and fastened on the valve housing, wherein the radially outwardly oriented flange is secured by the lid.

30. A camshaft adjuster for a camshaft of an internal combustion engine of a motor vehicle, the camshaft adjuster comprising:

a stator;

a rotor rotatable relative to the stator;

wherein between the stator and the rotor pressure chambers are defined;

at least one valve;

lines connecting the at least one valve to the pressure chambers;

wherein the at least one valve is configured to supply a pressure medium to the pressure chambers, respectively;

wherein the at least one valve is arranged on a side of the camshaft adjuster facing away from a connection of the camshaft adjuster to the camshaft;

wherein the at least one valve has a valve housing provided with at least one axial tank bore connectable to a tank connector of the at lesat one valve;

wherein the at least one valve has a hollow piston and wherein the axial tank bore communicates with an interior of th hollow piston;

at least one check valve arranged between the axial tank bore and the interior of the hollow piston and sealing relative to the tank bore.

31. The camshaft adjuster according to claim 30, wherein the at least one valve comprises a valve bushing and wherein the at least one check valve is arranged in the valve bushing.

32. The camshaft adjuster according to claim 30, wherein the valve bushing has at least one radial bore, wherein the at least one check valve comprises an annular band resting with elastic prestress against an inner wall of the valve bushing in an area of a least one radial bore.

33. The camshaft adjuster according to claim 32, wherein the interior of the hollow piston communicates with a pressure connector of the at least one valve.

* * * * *

UNITED STATES PATENT AND TRADEMARK OFFICE

CERTIFICATE OF CORRECTION

PATENT NO. : 6,871,621 B2
APPLICATION NO. : 10/436122
DATED : March 29, 2005
INVENTOR(S) : Palesch et al.

It is certified that error appears in the above-identified patent and that said Letters Patent is hereby corrected as shown below:

Col. 6, in claim 1, 4th line from the bottom, delete “lips” and insert instead --has--.

Col. 6, in claim 1, last line, cancel “protects” and insert instead --projects--.

Col. 6, in claim 9, line 3, insert --that-- before “is arranged upstream”.

Col. 6, in claim 12, line 2, delete “has” at the end of the line.

Col. 7, in claim 19, line 2, delete “project” and insert instead --projects.--.

Col. 8, in claim 28, last line, insert --of the-- after “recess”.

Col. 9, in claim 30, last line, change “th hollow” to --the hollow--.

Col. 10, in claim 32, last line, change “a least” to --at least--.

Signed and Sealed this

Eighteenth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 6,871,621 B2
APPLICATION NO. : 10/436122
DATED : March 29, 2005
INVENTOR(S) : Palesch et al.

It is certified that error appears in the above-identified patent and that said Letters Patent is hereby corrected as shown below:

Col. 6, in claim 1, line 33, from the bottom, delete “lips” and insert instead --has--.

Col. 6, in claim 1, line 36, cancel “protects” and insert instead --projects--.

Col. 6, in claim 9, line 59, insert --that-- before “is arranged upstream”.

Col. 6, in claim 12, line 67, delete “has” at the end of the line.

Col. 7, in claim 19, line 57, delete “project” and insert instead --projects.--.

Col. 8, in claim 28, line 54, insert --of the-- after “recess”.

Col. 9, in claim 30, line 14, change “th hollow” to --the hollow--.

Col. 10, in claim 32, line 10, change “a least” to --at least--.

This certificate supersedes the Certificate of Correction issued November 18, 2008.

Signed and Sealed this

Ninth Day of December, 2008

JON W. DUDAS
*Director of the United States Patent and Trademark Office*